US007118381B2

(12) United States Patent
Weidner

(10) Patent No.: US 7,118,381 B2
(45) Date of Patent: Oct. 10, 2006

(54) ELECTRICAL CONNECTOR WITH CONTACT SHIELDING MODULE

(75) Inventor: Kevin Edward Weidner, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/048,951

(22) Filed: Feb. 1, 2005

(65) Prior Publication Data

US 2006/0172562 A1 Aug. 3, 2006

(51) Int. Cl.
*H01R 12/00* (2006.01)

(52) U.S. Cl. ..... 439/63

(58) Field of Classification Search ..... 439/63, 439/581, 579, 394, 608; 29/883, 825
See application file for complete search history.

(56) References Cited

U.S. PATENT DOCUMENTS 4,659,156 A * 4/1987 Johnescu et al. ..... 439/63
5,169,343 A * 12/1992 Andrews ..... 439/608
5,215,470 A * 6/1993 Henry et al. ..... 439/63
6,808,414 B1 * 10/2004 Spiegel et al. ..... 439/579
2004/0058582 A1 3/2004 Wendling et al.

* cited by examiner

*Primary Examiner*—Alexander Gilman

(57) ABSTRACT

An electrical connector is provided having a housing with a connector mating side configured to receive a mating connector, a board mating side configured to be mounted to a circuit board and a contact exit side. The housing holds a contact that includes a contact body extending between a connector mating end and a board engaging end of the contact. The connector mating end is configured to join with the mating connector, while the board engaging end is configured to engage the circuit board. The contact body has an enclosed portion passing through the housing and an exposed portion extending from the contact exit side of the housing. A shielding module is provided immediately adjacent to the contact exit side of the housing and fitted around the exposed portion of the contact which extends between the contact exit side of the housing and the board mating end of the contact to shield the exposed portion.

19 Claims, 9 Drawing Sheets

ELECTRICAL CONNECTOR WITH CONTACT SHIELDING MODULE

BACKGROUND OF THE INVENTION

The present invention generally relates to an electrical connector with an add-on contact shielding module.

Electrical connectors are used today in a wide variety of applications, one area of which concerns connectors configured to interconnect coaxial cables with printed circuit boards. In some applications, right angle connectors are used to join the coaxial cables with the circuit board. The connector includes a cable mating face that can be configured to mate with either a connector plug or jack on the end of a coaxial cable. The cable mating face is formed at a right angle to the bottom of the connector, with the bottom being configured to be mounted to a circuit board. Contacts extend from the cable mating connector mating face through the housing of the connector and out a back side of the housing. The contacts are bent at a right angle to extend downward to engage contacts or vias on the circuit board.

However, conventional right angle coaxial connectors have met with certain disadvantages. In coaxial connectors, the signal contacts, that exit the connector housing before being joined to vias in the circuit board, expose a portion of the contact body to an open, ambient air environment. The portion of each contact that extends through air represents a non-shielded and non-impedance controlled area that may introduce signal transmission problems, such as cross talk, electromagnetic interference, impedance mismatch, digital bit errors and the like. Today, as data transmission rates increase, the need increases for fewer signal transmission errors. Many new high speed applications today require a very high level of shielding and impedance control. Yet, it is desirable to avoid the need to develop an entirely new connector configuration for such high speed applications.

BRIEF DESCRIPTION OF THE INVENTION

An electrical connector is provided having a housing with a connector mating side configured to receive a mating connector, a board mating side configured to be mounted to a circuit board and a contact exit side. The housing holds a contact including a contact body extending between a connector mating end and a board engaging end of the contact. The connector mating end of the contact is configured to join with the mating connector, while the board engaging end is configured to engage the circuit board. The contact body has an enclosed portion passing through the housing and an exposed portion extending from the contact exit side of the housing to the board mating end of the contact. A shielding module is provided immediately adjacent the contact exit side of the housing and fitted around the exposed portion of the contact to shield the exposed portion.

The shielding module may be formed with first and second shielding components that are mated with one another in a tongue and groove configuration about the exposed portion of the contact. Optionally, the shielding module may be mounted to the contact exit side of the housing or alternatively merely provided immediately adjacent the contact exit side of the housing without any direct connection to the housing. Optionally, the shielding module may include an L-shaped channel formed to fit around an L-shaped portion of the contact. The shielding module may be configured to be fit to the housing of a right angle board to coaxial connector.

In accordance with an alternative embodiment, a shielding module is provided that is configured to be fitted to an electrical connector that includes a housing and a contact. The connector is of the type where the housing includes a board mating side configured to be mounted to a circuit board and includes a contact exit side. The contact includes a contact body having an enclosed portion passing through the housing and an exposed portion extending from the contact exit side of the housing. The shielding module comprises first and second shielding components that are provided immediately adjacent to the contact exit side of the housing and fitted around the exposed portion of the contact to shield the exposed portion of the contact.

DETAILED DESCRIPTION OF THE INVENTION

Figure 1:
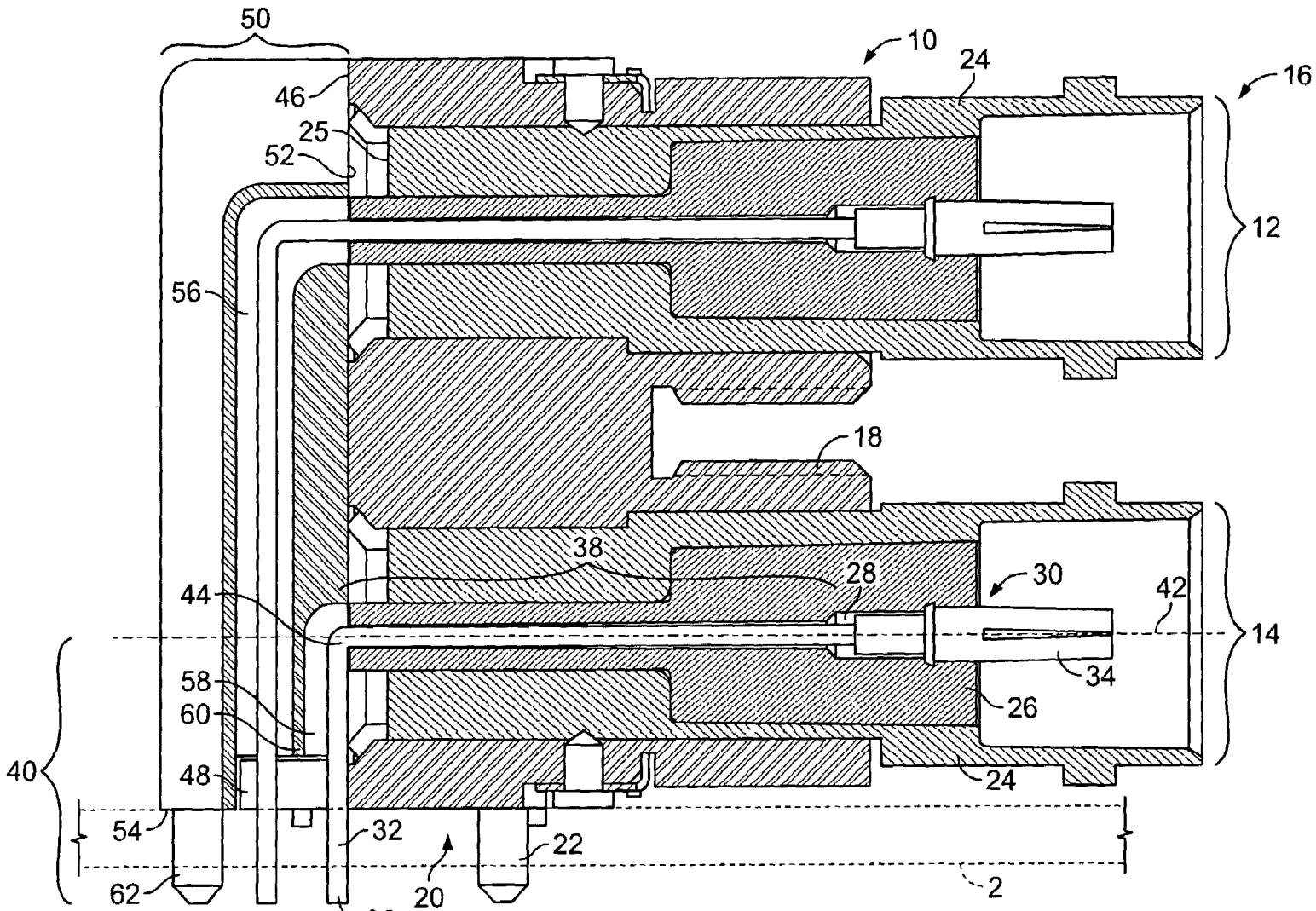
FIG. 1 illustrates a side sectional view of a two position electrical connector with a shielding module mounted thereto in accordance with an embodiment of the present invention.

FIG. 1 illustrates a side sectional view of a two position connector 10 formed in accordance with an embodiment of the present invention. By way of example only, the connector 10 may represent a BNC connector (e.g. Bayonet Neill Councelman) having two BNC jacks 12 and 14 at a front connector mating face 16. The BNC jacks 12 and 14 are configured to receive mating connectors. By way of example only, the mating connectors may represent coaxial cables, such as the RG-58 A/U cable used with 10 Base-2 Ethernet systems. The BNC jacks 12 and 14 may be joined with BNC connectors mounted at an end of a cable, where the BNC connector has a center pin connected to a center cable connector and a metal tube connected to an outer cable shield, with a rotating ring outside of the tube used to lock the cable to the BNC jacks 12 and 14. Alternatively, a wide variety of connector interfaces may be substituted for the BNC jacks 12 and 14, such as used with network interface cards, monitors, video adapters and the like.

The connector 10 also includes an insulated housing 18 that is configured to retain the BNC jacks 12 and 14. The housing 18 includes a bottom forming a board mating side 20 that is configured to be mounted on the surface of a circuit board 2. A metallized post 22 extends downward from the board mating side 20 and is configured to be securely received within a hole or via in the circuit board 2. In the embodiment of FIG. 1, the connector 10 represents a right angle BNC-to-printed circuit board connector. The housing 18 includes two cavities that receive the BNC jacks 12 and 14, respectively. Each BNC jack 12 and 14 includes a conductive grounded outer shell 24 that surrounds a dielectric layer 26 which has a passage 28 there through. Each passage 28 securely captivates a signal contact 30 to provide rigid control of the position and orientation of the contact 30.

The contact 30 includes a contact body 32 which extends between a connector mating end 34 and a board engaging end 36 of the contact 30. The connector mating end 34 is configured to engage a center pin of a BNC connector on a coaxial cable, while the board engaging end 36 is configured to be inserted a via in a circuit board. Optionally, the connector mating end 34 and board engaging end 36 may be modified to a variety of other configurations. The contact 30 is bent at a right angle such that an enclosed portion 38 of the contact body 32 extends horizontally along an axis 42 that is oriented parallel to the board mating side 20 (and thus to the surface of the circuit board 2 to which the connector 10 is mounted). The enclosed portion 38 is surrounded by the dielectric layer 26. The enclosed portion 38 transitions to an exposed portion 40 of the contact body 32 at a right angle bend 44. The right angle bend 44 orients the exposed portion 40 at a right angle or orthogonal to the board mating side 20 of the housing 18. Optionally, the enclosed portion 38 and the exposed portion 40 may be oriented at different angles with respect to one another and with respect to the board mating side 20 depending on the type of, and application for, the connector 10.

The connector 10 includes a contact exit side 46 oriented parallel to, and positioned opposing, the contact mating side 16. The contact exit side 46 is also oriented at a right angle to the board mating side 20. Optionally, the connector mating side 16, board mating side 20 and contact exit side 46 may be oriented at other non-orthogonal angles with respect to one another. Each contact 30 exits the contact exit side 46 of the housing 18 and is redirected at bend 44 downward toward the circuit board 2. In the example of FIG. 1, the contacts 30 are arranged in an over-under or stacked alignment with respect to the circuit board 2.

Figure 2:
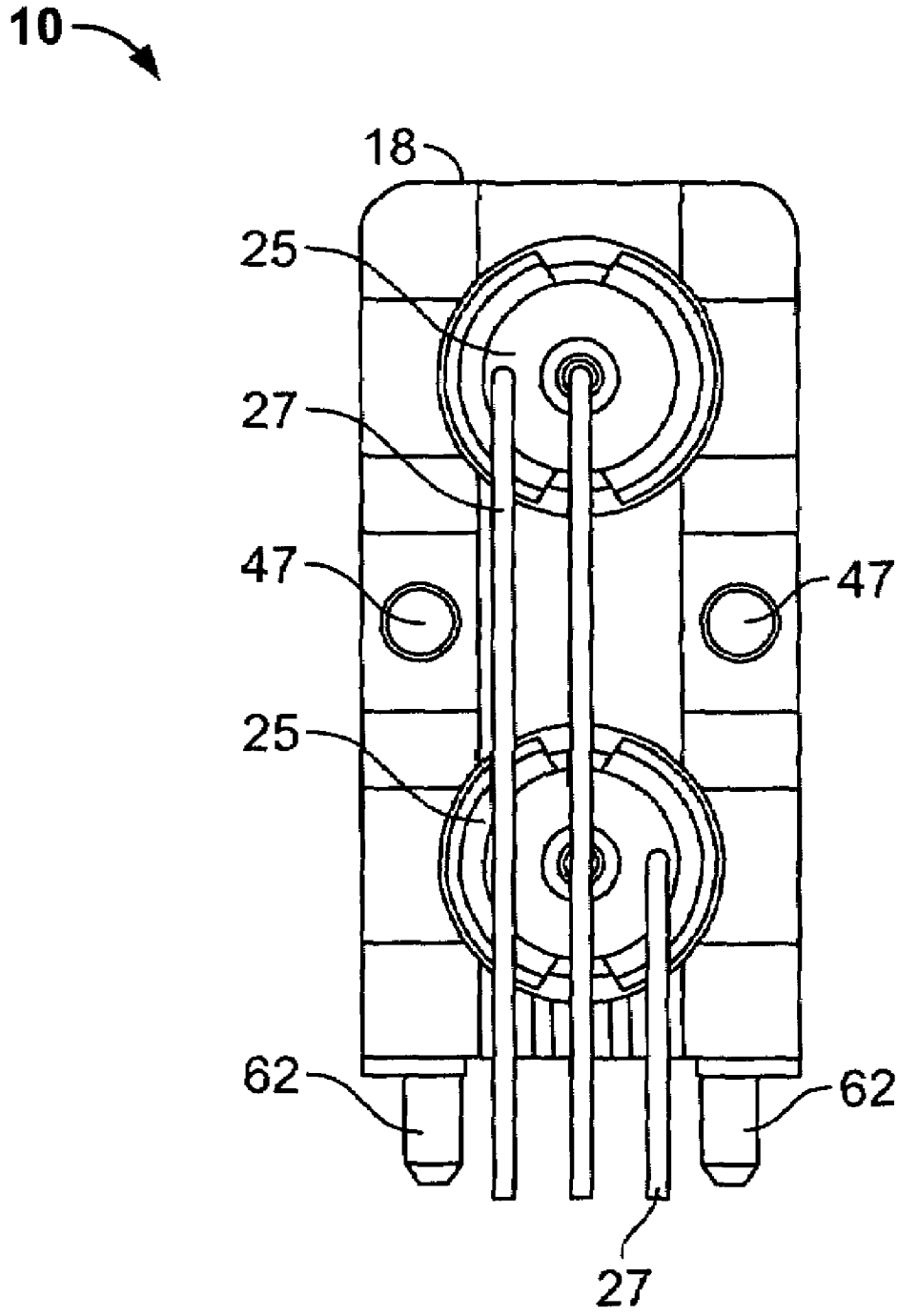
FIG. 2 illustrates a rear view of the electrical connector of FIG. 1 with the shielding module removed.

FIG. 2 illustrates a rear view of the connector 10 (with the shielding module 50 removed) to better illustrate the rear ends 25 of each grounded outer shell 24 of the BNC jacks 12 and 14 (FIG. 1). Grounding wires 27 (shown as manufactured without consideration for the use of shielding module 50) are joined to the rear ends 25 of the outer shells 24 to interconnect the outer shells 24 with the ground plane of the circuit board 2 (FIG. 1). Holes 47 are provided in the contact exit side 46 of the housing 18. The holes 47 align with holes 80 in components 66 and 68 (FIG. 3) to receive pins that hold the components 66 and 68 in a desired position proximate the contact exit side 46.

Returning to FIG. 1, a shielding module 50 is mounted to the housing 18 and abuts against the contact exit side 46 of the connector 10. The shielding module 50 is formed separate from the connector 10 and may be fitted to new connectors 10, or with modifications, added onto previously assembled connectors 10. The shielding module 50 is formed of a metallized material and has a connector engaging surface 52 and a board mating surface 54. The shielding module 50 includes separate channels 56 and 58 having discharge ends at the connector engaging surface 52 and board mating surface 54. The channels 56 and 58 are entirely isolated from one another by a shielding wall 60 formed therebetween. Posts 62 extend from the board mating surface 54 and are configured to be securely received in a hole or via in the circuit board to which the shielding module 50 is mounted. The posts 62 are metallized in order to establish a grounded connection between the grounding plane of the circuit board 2 and the shielding module 50.

The housing 18 includes a platform 48 extending rearward therefrom. The platform 48 is formed of an insulated material, as is the housing 18. The platform 48 includes holes there through that accept the contact body 32 at a close tolerance to maintain each contact 30 in a desired position with respect to one another.

Figure 3:
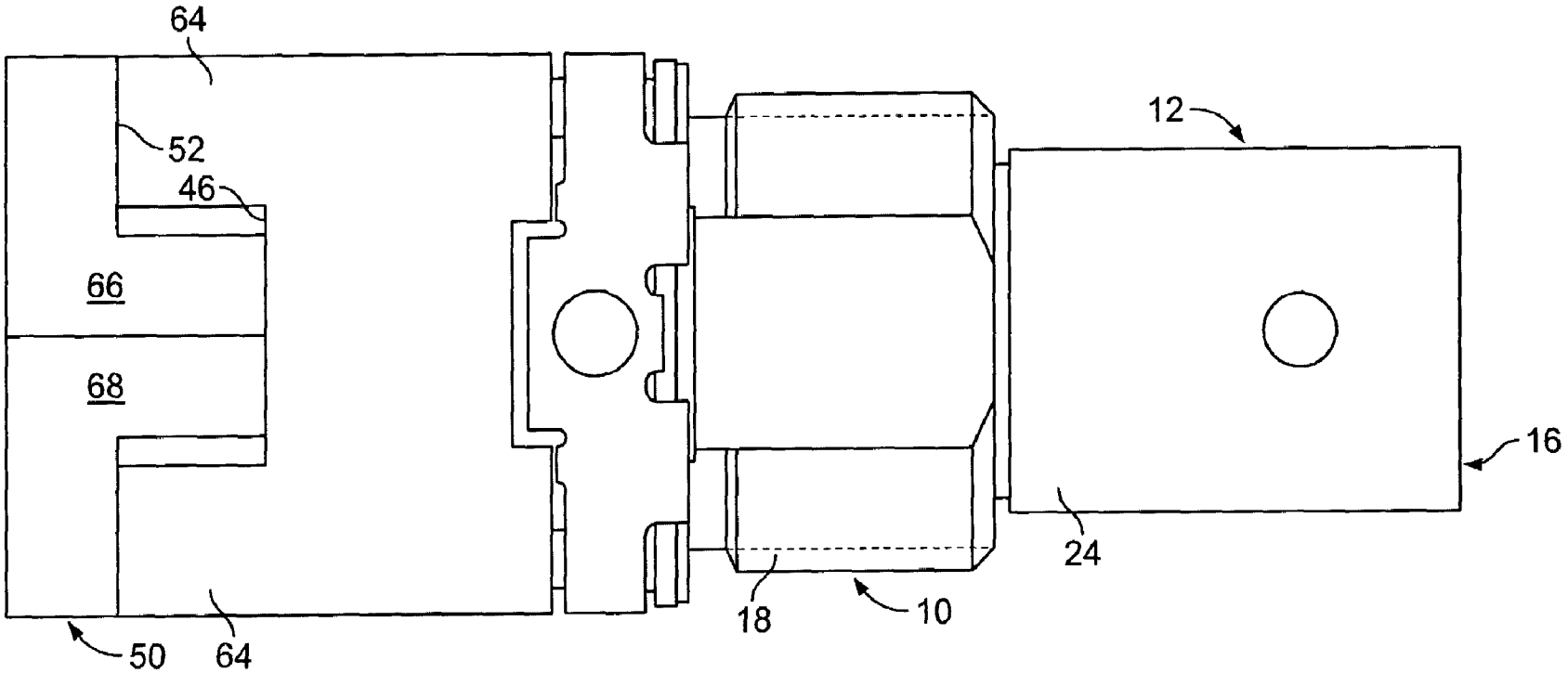
FIG. 3 illustrates a top plan view of the electrical connector of FIG. 1.

FIG. 3 illustrates a top plan view of the connector 10 and shielding module 50. As shown in FIG. 3, the connector 10 includes an outer shell 24 on each BNC jack 12 and 14. The contact exit side 46 of the connector 10 is formed in a stepped configuration with projections 64 extending rearward. As explained below in more detail, the projections 64 fit in an interleaved manner with features on the connector engaging surfaces 51 and 52 of the shielding module 50. As better illustrated in FIG. 3, the shielding module 50 is comprised of separate components 66 and 68 that join with one another, such as in a tongue and groove configuration.

Figure 4:
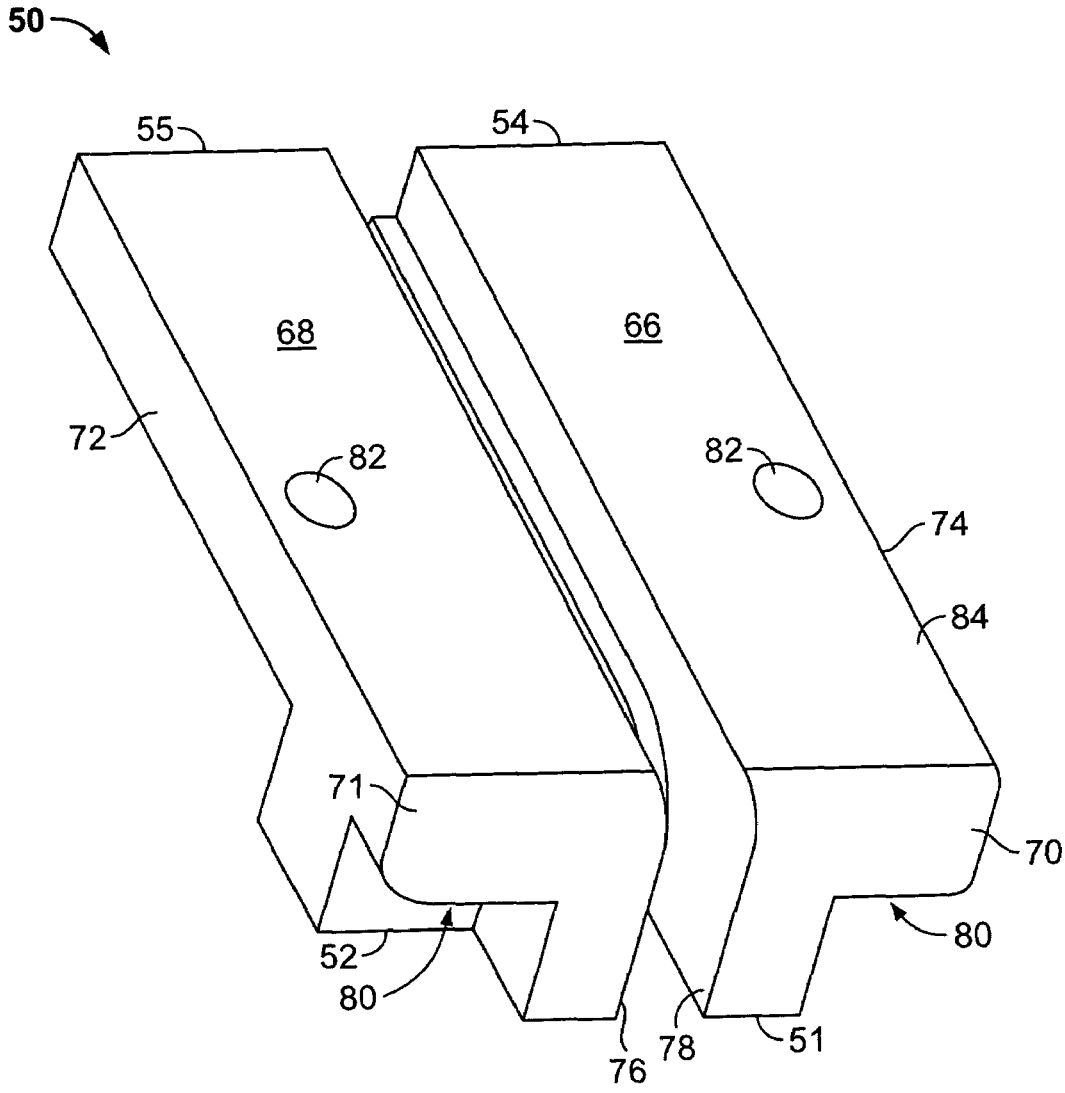
FIG. 4 illustrates a perspective view of a shielding module formed in accordance with an embodiment of the present invention.

FIG. 4 illustrates a perspective view of the components 66 and 68 forming the shielding module 50. Each component 66 and 68 include a connector engaging surface 51 and 52, a top surface 70 and 71, and outer sides 72 and 74 facing away from one another, respectively. Interior surfaces 76 and 78 face toward one another and are configured to abut against one another. Each component 66 and 68 also includes a board mating surface 54 and 55. Notched outer portions 80 are provided to receive the projections 64 (FIG. 3) extending from the contact exit side 46 of the housing 18. Apertures 82 are provided in the rear surfaces 84 of the components 66 and 68. The apertures 82 extend through the components 66 and 68 and are configured to receive pins that project into the holes 47 (FIG. 2) in the contact exit side 46 of the housing 18 to hold the components 66 and 68 firmly against one another and against the housing 18, and in a desired position with respect to the exposed portions 40 of the contacts 30 (FIG. 1).

Figure 5:
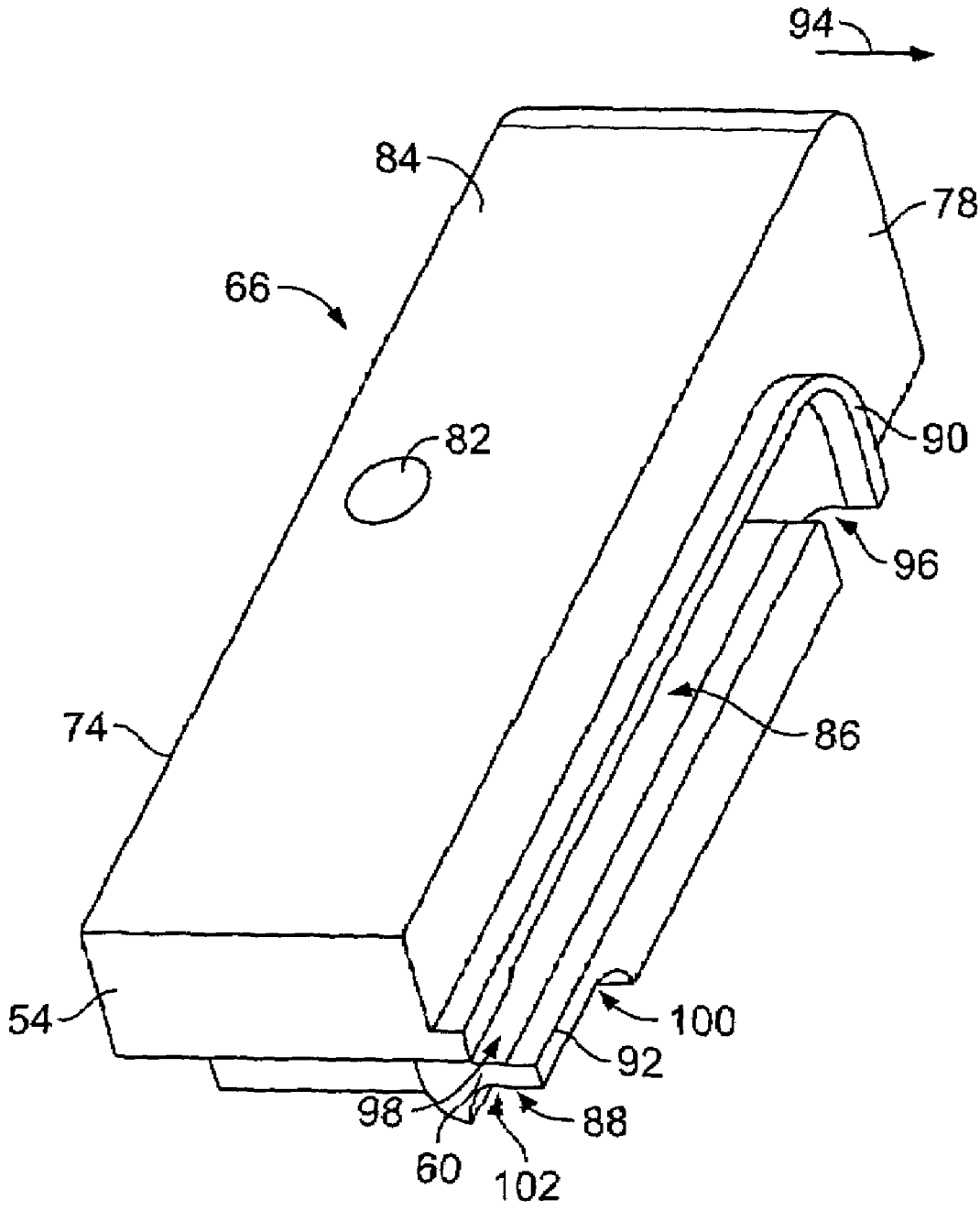
FIG. 5 illustrates a top perspective view of a tongue component of the shielding module of FIG. 4 formed in accordance with an embodiment of the present invention.

FIG. 5 illustrates a rear perspective view of the component 66 to better illustrate the features formed within the interior surface 78. The component 66 includes channels 86 and 88 notched into the interior surface 78. The channel 86 is bordered on opposite sides by ribs 90 and 92 that project outward beyond a plane of the interior surface 78 in the direction of arrow 94. The rib 92 and wall 60 collectively separate channels 86 and 88. Channel 86 includes open ends 96 and 98 that are positioned against the contact exit side 46 of the housing 18 (FIG. 1) and the surface of the circuit board 2. Channel 88 has open sides 100 and 102 that also abut against the contact exit side 46 of the housing 18 and the surface of the circuit board 2.

Figure 6:
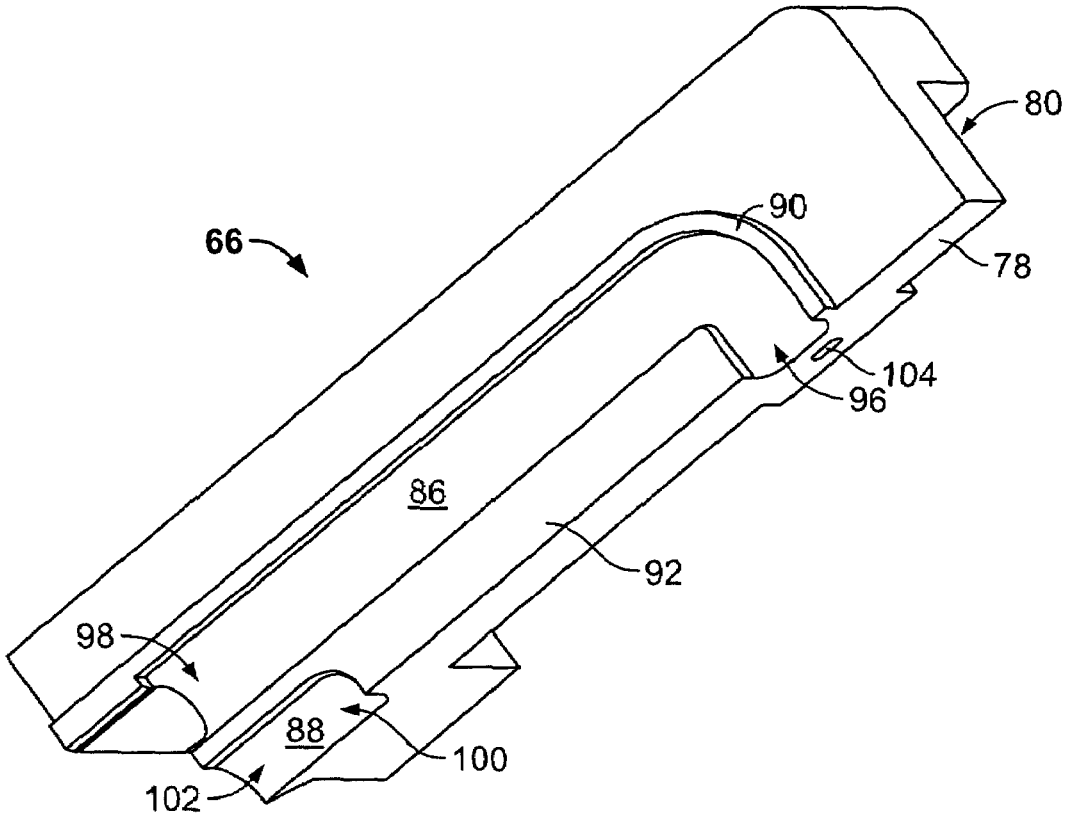
FIG. 6 illustrates a side perspective view of the mating face of the tongue component of FIG. 5.

FIG. 6 illustrates a side perspective view of the component 66 to better illustrate the channel 86 that extends entirely through the component 66 as well as the open ends 96 and 98 of the channel 86. As more clearly shown in FIG. 6, the channel 86 may be provided with an L-shape to follow the contour of the exposed portion 40 of contact 30 (FIG. 1). FIG. 6 illustrates the channel 88 to include open sides 100 and 102. The interior surface 78 includes a ground wire receiving hole 104 which extends partially into interior surface 78. The hole 104 accepts one of the ground wires 27 (FIG. 2) that extends from the rear end 25 of the outer shell 24 (FIG. 3) and the ground wires 27 are mechanically staked to component 66 to provide an electrical connection through the component 66 and downward to engage the ground plane of the circuit board 2.

Figure 7:
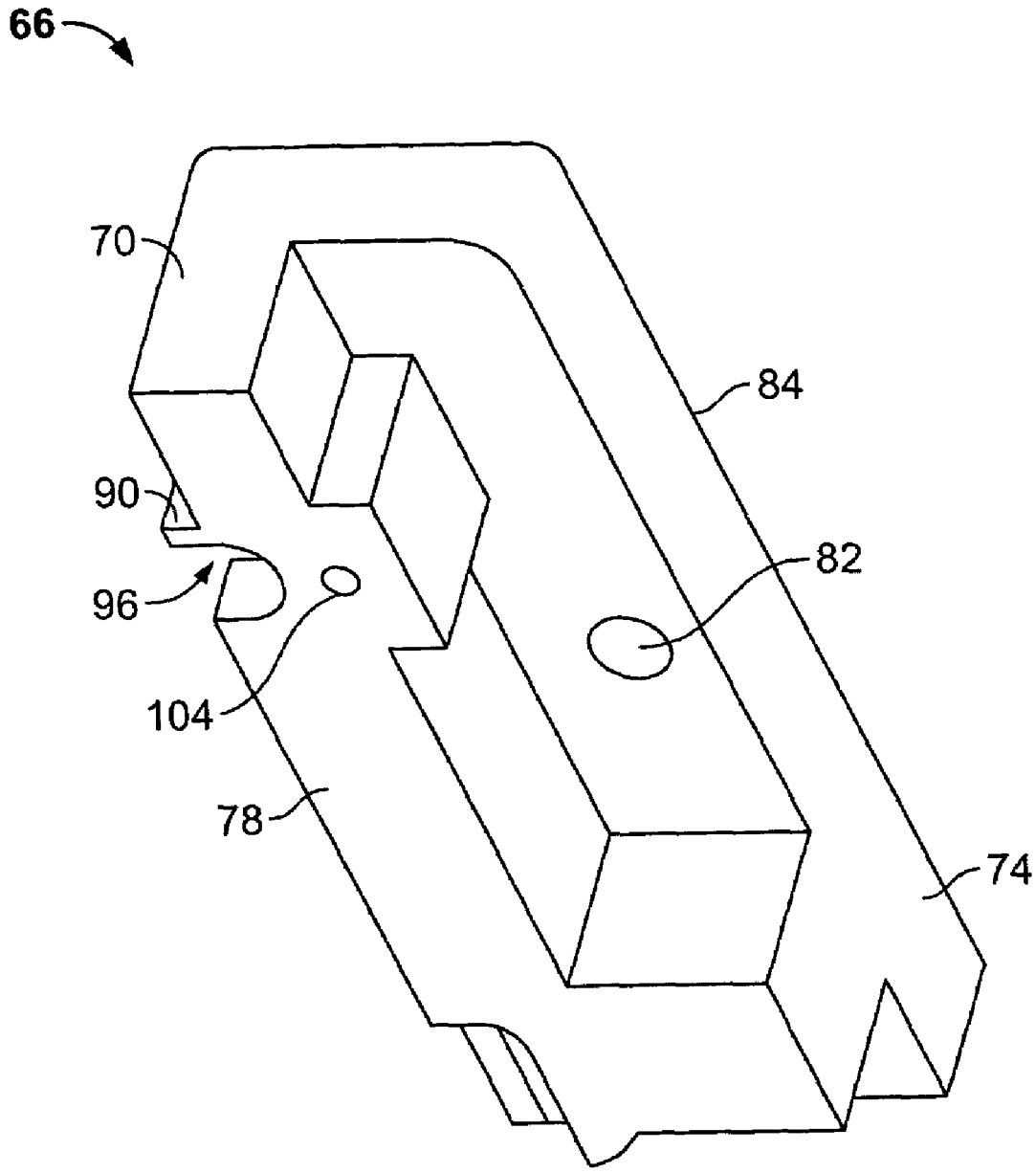
FIG. 7 illustrates a rear perspective view of the tongue component of FIG. 5.

FIG. 7 illustrates a perspective view of the component 66 to better illustrate the contour of the outer surface 74. As also shown in FIG. 7, the open end 96 forms a semi-circular opening in order to be loaded onto the exposed portion 40 of the contact 30 from the side after the contact 30 is loaded into, or formed with, the housing 18.

Figure 8:
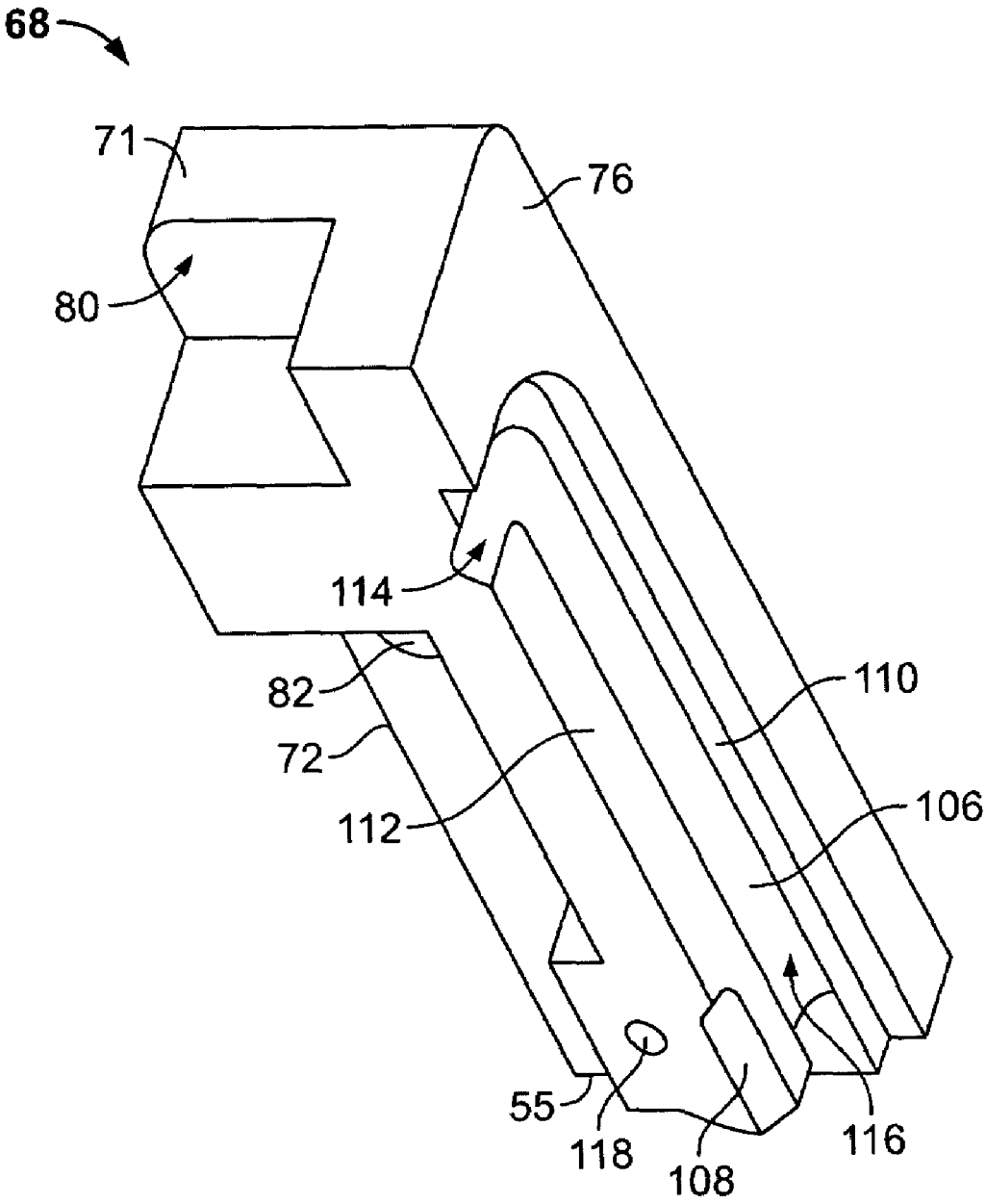
FIG. 8 illustrates a side perspective view of a groove component of the shielding module of FIG. 4 formed in accordance with an embodiment of the present invention.

FIG. 8 illustrates a front perspective view of the component 68 that is configured to mate with the component 66 (FIGS. 5–7). The component 68 includes the top 71, interior surface 76, board mating surface 55 and outer surface 72. The interior surface 76 includes channels 106 and 108 cut therein. Channel 106 is bordered by grooves 110 and 112 that are configured to mate with the ribs 90 and 92 on component 66. The channel 106 is L-shaped and has an open end 114 configured to abut against the contact exit side 46 of the housing 18 (FIG. 1). The channel 106 further includes open end 116 configured to engage, and be located proximate, a surface of the circuit board 2. The groove 110 is also L-shaped to receive the L-shaped rib 90 (FIG. 5).

Aperture 82 extends through the component 68 to receive a pin which retains the component 68 against the contact exit side 46 of the housing 18. A hole 118 extends partially into component 68 is configured to receive the ground wire 27 extending from the outer shell 24 of the BNC jack 14 (FIG. 1). The ground wire 27, extending into hole 118 is mechanically staked to component 68 to provide and electrical connection through component 68 and downward to engage the ground plane of the circuit board 2.

Figure 9:
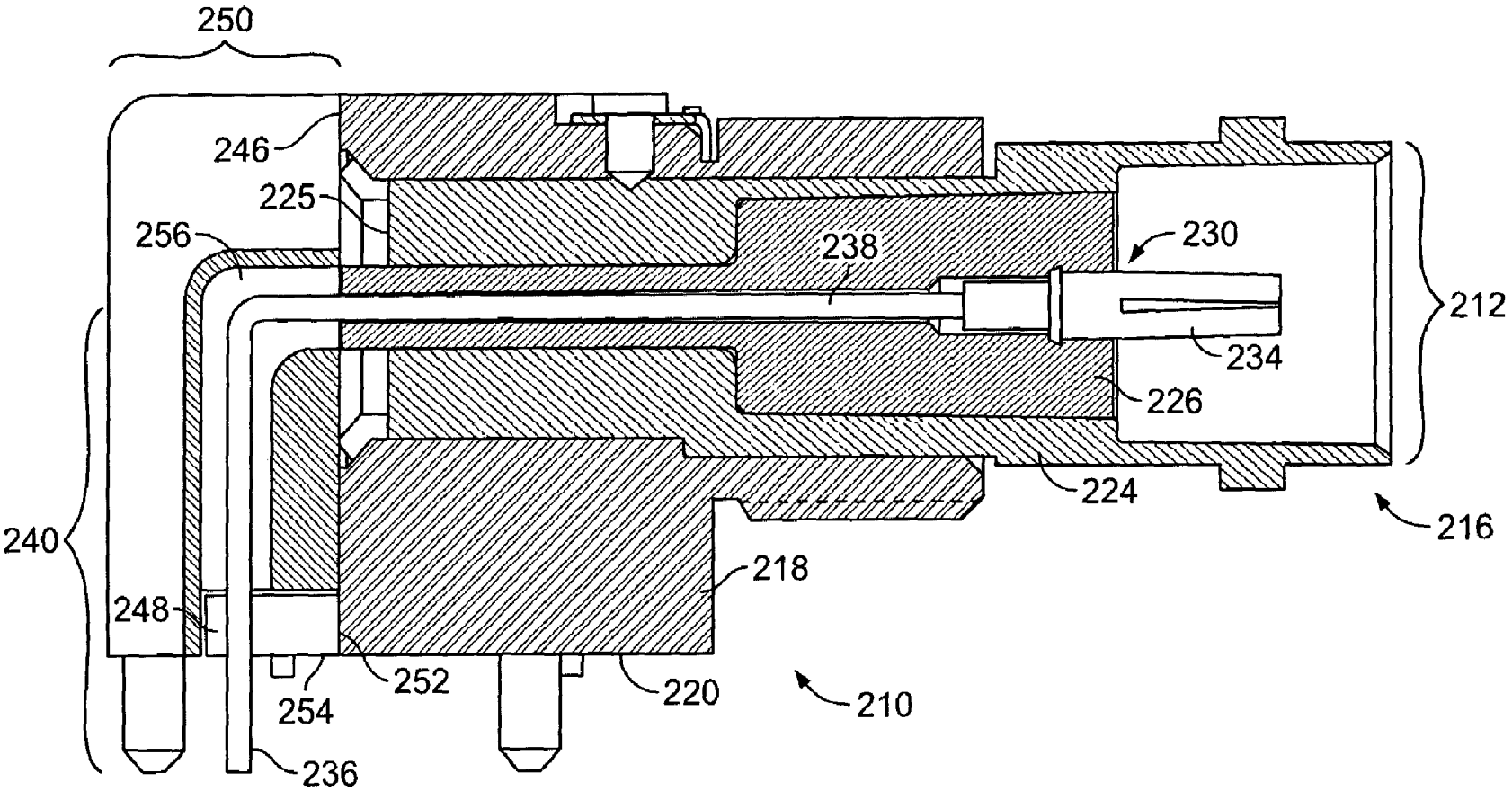
FIG. 9 illustrates a side sectional view of a single position connector with a shielding module providing thereon in accordance with an embodiment of the present invention.

FIG. 9 illustrates a connector 210 formed in accordance with an alternative embodiment. The connector 210 represents a single position type connector having a single BNC jack 212 with an outer shell 224 held within a housing 218. The housing 218 has a connector mating side 216, a board mating side 220 and a contact exit side 246. The connector 210 is joined to a shield module 250 having a board mating surface 254 and a connector engaging surface 252. A passage 256 is formed through the shielding module 50 to accept and shield an exposed portion 240 of a contact 230. The contact 230 has a connector mating end 234 and a board engaging end 236. The contact 230 also includes an enclosed portion 238 held within a dielectric layer 226. The dielectric layer 226 separates the contact 230 from the shell 224.

The passages through the shielding modules form an air cavity around the corresponding signal contact that provides shielding and impedance control for each individual signal contact. The shielding components joined with one another to form the shielding modules are interconnected in a tongue and groove manner to avoid leakage of electromagnetic fields at the interface between the components of the shielding module. The exposed portions of the contacts do not touch the shielding module, but instead are surrounded by an air pocket within each isolated passage.

While the invention has been described in terms of various specific embodiments, those skilled in the art will recognize that the invention can be practiced with modification within the spirit and scope of the claims.

What is claimed is:

1. An electrical connector, comprising:

a housing having a connector mating side configured to receive a mating connector, a board mating side configured to be mounted to a circuit board, and a contact exit side;

a dielectric layer held in said housing and terminating at said contact exit side;

a contact held in said dielectric layer in said housing and having a contact body extending between a connector mating end and a board engaging end of said contact, said connector mating end being configured to join with the mating connector, said board engaging end being configured to engage the circuit board, said contact body having an enclosed portion within said dielectric layer passing through said housing and an exposed portion extending from said contact exit side of said housing beyond said dielectric layer to the circuit board; and a shielding module provided immediately adjacent said contact exit side of said housing and fitted around said exposed portion of said contact extending between said contact exit side of said housing and said board mating end of the contact to shield said exposed portion, wherein said shielding module includes first and second components having partial channels formed therein, said partial channels fitting within one another to surround said exposed portion of said contact, said partial channels being separated from said exposed portion by an air gap.

2. The electrical connector of claim 1, wherein said first and second shielding components mate with one another in a tongue-and-groove configuration about said exposed portion of said contact.

3. The electrical connector of claim 1, wherein said housing includes a platform extending rearward from said contact exit side said shielding module is mounted on said platform.

4. The electrical connector of claim 1, wherein said contact exit side of said housing is oriented at a non-parallel angle with said board mating side of said housing such that said contact exit side extends away from the circuit board when said board mating side is mounted in an abutting relation to the circuit board.

5. The electrical connector of claim 1, wherein said shielding module includes an L-shaped channel formed to fit around said exposed portion of said contact.

6. The electrical connector of claim 1, further comprising a grounding shell provided in said housing and surrounding said contact, and a dielectric layer separating said grounding shell from said contact in a coaxial arrangement.

7. The electrical connector of claim 1, wherein said exposed portion of said contact includes a bend to orient said board engaging end orthogonal to the circuit board.

8. The electrical connector of claim 1, wherein said connector mating and board mating sides of said housing are oriented at a right angle with one another.

9. The electrical connector of claim 1, wherein said shielding module is configured to be retrofitted to a right angle board-to-coaxial connector type of said housing.

10. The electrical connector of claim 1, wherein said housing includes a platform extending rearward from said contact exit side, said platform having a hole therethrough, said exposed portion of said contact extending from said partial channels and through said hole in said platform, said hole maintaining a close tolerance to said exposed portion to maintain said contact in a desired position with respect to said partial channels.

11. An electrical connector, comprising:

a housing having a connector mating side configured to receive a mating connector, a board mating side configured to be mounted to a circuit board, and a contact exit side, said housing including a platform extending rearward from said contact exit side and having a hole therethrough:

a contact held in said housing and having a contact body extending between a connector mating end and a board engaging end of said contact, said connector mating end being configured to join with the mating connector, said board engaging end being configured to engage the circuit board, said contact body having an enclosed portion passing through said housing and an exposed portion extending from said contact exit side of said housing to the circuit board; and a shielding module provided on said platform and located immediately adjacent said contact exit side of said housing and fitted around said exposed portion of said contact extending between said contact exit side of said housing and said board mating end of the contact to shield said exposed portion, wherein said shielding module includes first and second components joined to one another at contact engaging faces to form a channel to surround said exposed portion of said contact, said exposed portion of said contact extending from said channel and through said hole in said platform, said hole maintaining a close tolerance to said exposed portion to maintain said contact in a desired position with respect to said channel.

12. A shielding module configured to be fitted to an electrical connector that includes a housing and a contact, the housing including a board mating side configured to be mounted to a circuit board and a contact exit side, the contact including a contact body having an enclosed portion passing through said housing and an exposed portion extending from the contact exit side of the housing, the shielding module comprising:

first and second shielding components provided immediately adjacent the contact exit side of the housing, the first and second shielding components having partial channels fitting with one another around the exposed portion of the contact extending between the contact exit side of the housing and a board mating end of the contact to shield the exposed portion of the contact, said partial channels being separated from said exposed portion only by an air gap and without any dielectric layer therebetween.

13. The shielding module of claim 12, wherein said shielding module is mounted to the contact exit side of the housing and abutting against a rear end of an outer shell held in the housing.

14. The shielding module of claim 12, wherein at least one of said first and second shielding components includes an L-shaped channel formed to fit around the exposed portion of the contact.

15. The shielding module of claim 12, wherein said first and second components each have partial channels formed therein, said partial channels fitting within one another to surround the exposed portion of the contact.

16. The shielding module of claim 12, wherein said first and second components have contact engaging faces joining with one another to surround the exposed portion of the contact, said contact engaging face of said first component including a rib projecting outward from said contact engaging face, said contact engaging face of said second component including a notch configured to receive said rib when said first and second components are mated with one another.

17. The shielding module of claim 12, wherein said first and second components include a board engaging end configured to abut against a circuit board and a connector engaging end configured to abut against the contact exit side of the housing.

18. The shielding module of claim 12, wherein said first and second shielding components mate with one another in a tongue-and-groove configuration about the exposed portion of the contact.

19. The shielding module of claim 18, wherein said first and second components are configured to be retrofit to a right angle board-to-coaxial connector.

* * * * *